United States Patent [19]

Hawkins

[11] Patent Number: 4,651,912

[45] Date of Patent: Mar. 24, 1987

[54] HAMMER-ACTIVATED FASTENER TOOL

[75] Inventor: Robert E. Hawkins, Anderson, Ind.

[73] Assignee: Uniset Corporation, Indianapolis, Ind.

[21] Appl. No.: 738,272

[22] Filed: May 28, 1985

[51] Int. Cl.[4] ..... B25C 1/14

[52] U.S. Cl. ..... 227/8; 227/9; 227/10; 227/149

[58] Field of Search ..... 227/8–10, 227/149, 11

[56] References Cited

U.S. PATENT DOCUMENTS

| | | | |
|---|---|---|---|
| 3,066,302 | 12/1962 | DeCaro et al. | 227/10 |
| 3,468,465 | 9/1969 | Mulno | 227/10 |
| 3,688,964 | 9/1972 | DeCaro | 227/10 |
| 4,025,029 | 5/1977 | Kotas et al. | 227/10 |
| 4,252,259 | 2/1981 | Brosius | 227/8 |

*Primary Examiner*—Howard N. Goldberg
*Assistant Examiner*—Taylor J. Ross
*Attorney, Agent, or Firm*—William W. Jones

[57] ABSTRACT

The tool has a reciprocating barrel mounted in a housing and includes a ram mounted in the barrel for driving a fastener into a work surface. The firing mechanism has a firing pin and a firing pin driver which the operator strikes with a hammer to fire a cartridge chambered in the tool. The firing pin driver is biased to a retracted safe position when the tool is not cocked so as to prevent drop fire. A detent pawl is mounted on the ram to provide frictional retention forces for the ram and barrel. The pawl cooperates with a resilient stop mounted on the housing to return the ram from a driven position to a driving position when the barrel is reciprocated in the housing, and the pawl also engages a breechward stop formed in the housing which prevents the ram from contacting a chambered cartridge when the tool is in a breech-closed, ready-to-fire condition. Bellville washer stacks are used to position the firing mechanism. An improved hand grip is also provided. The grip is fitted about the tool housing and is made from a relatively soft plastic such as a poly propylene. It includes a breechward conical shield which protects the hand, and a resilient muzzleward deflectable flange for operator comfort.

17 Claims, 8 Drawing Figures

HAMMER-ACTIVATED FASTENER TOOL

This invention relates to a powder-actuated fastener-driving tool which is operated by being struck with a hammer.

Powder-actuated fastener-driving tools which include a fastener driving ram returned from a fired position to a firing position by reciprocating the barrel of the tool are known in the prior art. Such a tool is disclosed in U.S. Pat. No. 3,066,302 to De Caro. Such tools may be trigger operated, or may be operated by being struck with a hammer, as in U.S. Pat. No. 4,025,029 to Kotas et al.

This invention relates to a tool of the general type disclosed in U.S. Pat. No. 4,025,029 to Kotas et al which is fired by being struck with a hammer and which uses a returnable ram powered by the fired cartridge to drive the fastener but which has several improved features. The tool disclosed in the Kotas et al patent has a firing pin which is biased by a coil spring in a direction away from the cartridge chamber. Thus, the firing end of the firing pin is held away from the cartridge by the coil spring, and the hammer striking end of the firing pin is biased out of the rear end of the tool by the same coil spring. To fire the tool, the firing chamber is moved breechwardly toward the firing pin to a position where the firing end of the pin can strike the head of the cartridge when the hammer striking end of the firing pin is struck with a hammer. In order to protect the tool against drop fire which could occur due to the protruding end of the firing pin, a handle grip is provided which has a rearwardly extending conical flange shielding the protruding end of the firing pin. This shield is operable if the tool is dropped on a flat surface. If the tool were dropped on a stone, or other irregular surface, the ability of the shield to prevent drop fire is questionable.

The tool of this invention provides improved protection against drop fire by using a firing mechanism which is retracted inside the tool housing unless and until the muzzle end of the tool is pressed against a work surface preparatory to driving a fastener into the work surface. Thus, the tool must be cocked by a push down movement, a safety feature usually found only in trigger operated fastener driving tools. The improved firing mechanism has a firing pin and a firing pin driver which may be one piece or separate pieces. The firing pin driver is biased by a coil spring in the muzzleward direction, thus the driver is biased toward the cartridge rather than away from it. This means that the striking end of the driver is biased by the spring to a retracted position where it cannot be struck by a hammer or by anything on which the tool is dropped. When the tool is pressed against a work surface, the barrel pushes a firing pin retainer, or the firing pin, against the driver to compress the spring and move the rear end of the driver out of the tool housing to a projecting position where it can be struck by the hammer.

The firing pin can be controlled by Bellville washer stacks which will allow limited firing pin movement when the hammer is used to actuate the tool. This arrangement allows minimal rebound, thus reducing the liklihood of cartridge head blowout. A urethane sleeve may be substituted for the Bellville washers.

The ram is reciprocally moveable in the bore of the barrel between a breechward driving position and a muzzleward driven position. The ram is returned from its driven position to its driving position by reciprocating the barrel, in a generally known manner. In order to properly position the ram in the barrel bore to ensure proper power levels, a spring-biased pawl is mounted on the ram extending radially thereof. The pawl extends through a longitudinal slot in the barrel into frictional engagement with the inner surface of the tool housing. The pawl thus provides frictional drag for the ram relative to the housing. In addition, the fact that the ram is mounted in the barrel results in the pawl also providing frictional drag for the barrel with respect to the housing. The pawl thus holds the barrel in its breech closed position after loading while the tool is being carried about, and the pawl also holds the ram in its driving position in the barrel after reciprocation of the barrel. The pawl also provides a third function in that it serves as the ram return surface on the ram. A spring clip is mounted on the housing and includes a portion which extends into the pawl slot in the barrel. The spring clip thus serves to prevent the barrel from disconnecting from the housing. The part of the spring clip which extends into the barrel slot is bent toward the breech of the tool so as to provide a resilient shock absorbing stop for engaging the ram pawl when the barrel is reciprocated to return the ram from its driven position to its driving position. The resiliency and shock absorbing characteristics of the ram return stop is important since the pawl is a relatively small member which should not be exposed to excessive stresses. Such stresses can arise in tools of this type when the operator throw-cocks them. This type of movement involves grasping the tool housing and snapping the tool muzzleward to snap the barrel away from the housing. This causes the ram return part of the tool to slam into the surface of the ram which operates as the return surface. Repeated throw-cocking can thus damage one or both such parts of the tool unless provision is made to minimize stresses by such a maneuver. The spring clip is covered by a sleeve removably mounted on the tool housing whereby the sleeve can be removed from the housing to gain access to the spring clip to disassemble the tool. The pawl also provides protection against drop fire. The inner surface of the tool housing has a notch providing a stop shoulder formed therein along the path of travel of the pawl. The notch is spaced muzzlewardly from the firing chamber a distance such that when the ram is in its driving position and a cartridge is in the firing chamber, the pawl engages the notch stop shoulder and the ram is thus prevented from moving closer to the cartridge in the chamber. This prevents the ram from being displaced breechwardly when the tool is dropped so that the ram is unable to accidentally dislodge the cartridge from the chamber and crush the cartridge rim against the breech block. Such an accidental firing can occur if the notch stop shoulder is not present.

The tool is also provided with a molded grip which is made from a relatively soft plastic such as polypropylene or the like. The grip is fitted onto the breechward end of the housing and includes a breechward conical shield similar to the prior art for additional protection and a resilient muzzleward flange which is undercut for added flexibility so as to provide added comfort for the operator's hand. Deflection of the muzzleward flange of the grip during operation of the tool substantially reduces the discomfort which can accompany extended use of tools of this general type.

It is, therefore, an object of this invention to provide an improved powder-actuated fastener-driving tool which is actuated by being struck with a hammer.

It is an additional object of this invention to provide a tool of the character described which has an improved firing mechanism designed to prevent drop fire from occurring.

It is a further object of this invention to provide a tool of the character described which has provisions for frictionally maintaining the barrel in a breech closed position and the ram in a driving position to prevent accidental displacement of these elements.

It is an additional object to provide a tool of the character described which has provisions for holding the ram against breechward movement when the ram is in its driving position.

It is another object of this invention to provide a tool of the character described which has a shock-absorbing ram return member mounted on the tool housing.

These and other objects and advantages of the invention will become more readily apparent from the following detailed description of several preferred embodiments thereof when taken in conjunction with the accompanying drawings, in which.

Figure 1:
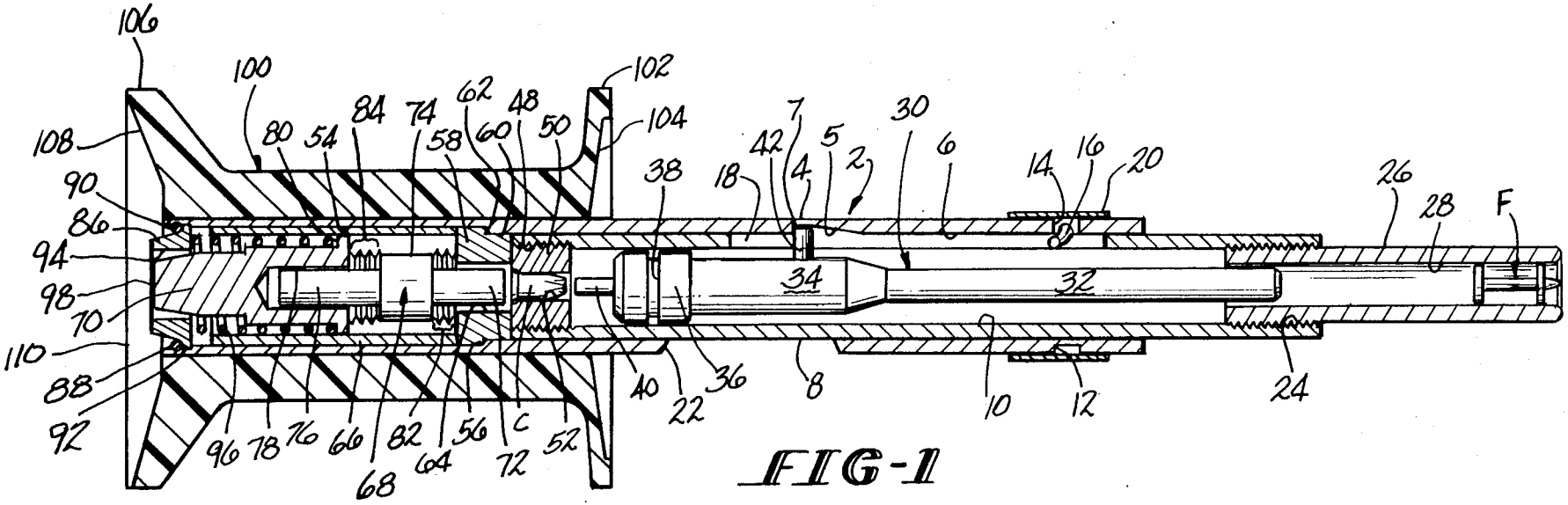
FIG. 1 is an axial sectional view of a first embodiment of a tool formed in accordance with this invention, the tool being shown loaded with its ram in its driving position.
Figure 7:
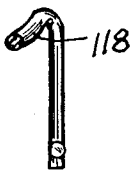
FIG. 7 is a sectional view taken along line 7—7 of FIG. 6.
Figure 6:
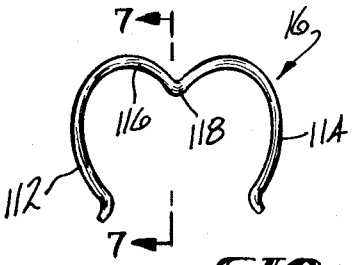
FIG. 6 is an elevational view of the barrel retention and ram return spring clip used in the tool.

Referring now to the drawings, there is shown in FIG. 1 a first embodiment of a tool formed in accordance with this invention. The tool, denoted generally by the numeral 2, includes a tubular housing 4 having a bore 6 in which is mounted a barrel 8 having a barrel bore 10. The housing 4 has an external circumferential groove 12 which opens into a through passage 14. A spring ring 16 is mounted in the groove 12 and extends through the passage 14 into a longitudinal slot 18 which is formed in the barrel 8. The barrel 8 is reciprocally slidably mounted in the housing bore 10 and the spring 16 serves to retain the barrel 8 in the housing bore 6. A band 20 is fitted onto the housing 4 overlying the groove 12 and ring 16 to protect the ring 16 and keep it in place. The band 20 can be removed from the housing 4 to disassemble the tool. Details of the ring 16 are shown in FIGS. 6 and 7, which will be referred to in greater detail hereinafter. The housing 4 is provided with a loading port 22 through which cartridges are loaded into and ejected from the tool.

Figure 5:
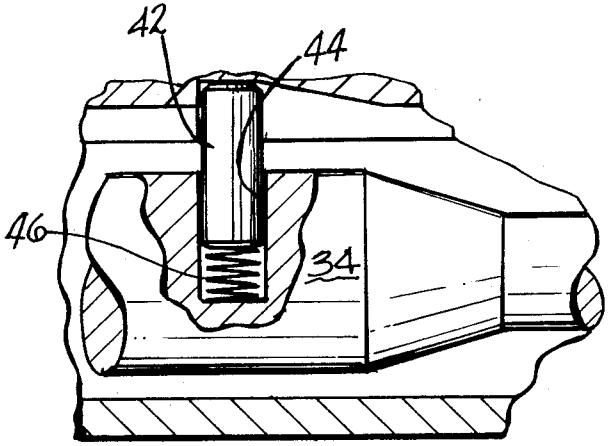
FIG. 5 is a fragmented sectional view of the ram portion of the tool showing how the return and friction pawl is mounted in the ram.

The muzzleward end of the barrel bore 10 is threaded at 24, and a muzzle bushing 26 is screwed into the barrel 4 via the threads 24. The muzzle bushing 26 has a bore 28 in which fasteners F to be driven are seated. A fastener-driving ram 30 is reciprocally slidably mounted in the barrel bore 10. The ram 30 includes a muzzleward stem 32, an intermediate neck portion 34, and a breechward head 36. A circumferential groove 38 is formed in the head 36. A cartridge ejector tail 40 projects from the breechward end of the ram 30. A radially extending pawl 42 is mounted in a blind bore 44 drilled in the neck 34 of the ram 30, as shown in FIG. 5. The pawl 42 is biased outwardly by a coil spring 46 against the wall of the housing bore 6 so that the pawl 42 provides frictional drag for the ram 30 within the housing 4. The pawl 42 thus retains the ram 30 in proper position within the housing 4 and also within the barrel 8. The reaction by the ram 30 to the bias of the pawl 42 creates friction between the ram 30 and the barrel bore 10 which, in turn, causes frictional maintenance of position of the barrel 8 within the housing bore 6. The pawl 42 thus provides frictional positioning of the ram 30 within the barrel bore 10 and also provides frictional positioning of the barrel 8 within the housing bore 6. A notch 5 is formed in the housing bore 6 providing a stop shoulder 7 for engagement by the pawl 42 to limit the extent of breechward movement the ram 30 can undergo when in its driving position. The pawl 42 also provides the ram return contact surface when the ram is returned from its fired position to its firing position, as will be explained in greater detail hereinafter. The breechward end of the barrel bore 10 is threaded at 48 so as to threadably receive a cartridge chamber body 50 in which the cartridge chamber 52 is located. Blank cartridges C are chambered in the chamber 52 to operate the tool 2. As shown in FIG. 1, the tool is shown in a loaded, breech closed condition with the ram 30 being shown in its driving position. It will be noted that the muzzleward end of the ram stem 32 is positioned in the bore 28 of the muzzle bushing 26.

In the breechward end of the housing 4, there is disposed an enlarged counter-bore 54 which opens into the housing bore 6 at a radial shoulder 56. A firing pin retainer 58 is mounted in the counter-bore 54, the retainer 58 having a boss 60 which extends into the housing bore 6. The retainer 58 has a shoulder 62 which engages the shoulder 56 in the housing 4. The retainer 58 has a through bore 64. The muzzleward face of the retainer 58 is engaged by the breechward faces of the barrel 8 and the cartridge chamber body 50 when the tool is in its breech-closed condition shown in FIG. 1. A retainer sleeve 66 is mounted in the counter-bore 54, and a firing pin 68 and firing pin driver 70 are mounted in the retainer sleeve 66. The firing pin 68 has a nose portion 72 extending through the retainer bore 64, a medial flange 74, and a tail portion 76. The firing pin driver 70 includes a bore 78 into which the firing pin tail 76 extends, and a muzzleward radial flange 80. A first set of cooperating Bellville washers 82 is mounted on the nose 72 of the firing pin 68 and sandwiched between the firing pin flange 74 and the firing pin retainer 58. A second set of cooperating Bellville washers 84 is sandwiched between the firing pin flange 74 and the firing pin driver 70. The Bellville washer sets 82 and 84 serve to properly position the firing pin 68 in the sleeve 66 and, also, provide connections between the driver 70 and firing pin 68, and the retainer 58 and firing pin 68. A firing mechanism retainer 86 is mounted in a counter-bore 87 formed in the counter-bore 54, the retainer 86 being fixed in place by a retaining spring ring 88 which is seated in a groove 90 in the counter-bore 87. The ring 88 engages a flange 92 on the retainer 86 to prevent the latter from coming out of the housing 4. The retainer 86 has a through bore 94 through which the driver 70 telescopes. A coil spring 96 is sandwiched between the retainer 86 and the driver flange 80 so as to bias the driver 70 toward the firing pin 68 and against the Bellville washer set 84. The coil spring 96 is operable to prevent the end 98 of the driver 70 from protruding past the retainer 86 when the tool is at rest. This helps to guard against the possibility of drop firing the tool.

An elastomeric plastic hand grip 100 is fitted onto the exterior of the housing 4 at the breechward end thereof. The grip can be made from a relatively soft plastic such as polypropylene or the like. The muzzleward end of the grip 100 has a radial flange 102 which is under cut at 104 so as to increase the flexibility of the flange 102. The flange 102 thus provides comfortable, yielding support for the edge of the operator's hand. The breechward end of the grip 100 is formed with a radial flange 106 which is thick and rigid and which has a conical exterior surface 108 terminating at a surface 110 which is spaced outwardly of corresponding end surfaces of the housing 4, retainer 86 and firing pin driver 70. This grip surface 110 provides additional protection against drop fire of the tool 2 and, also, protects the operator's hand against accidentally being struck by the hammer when the tool is fired. A similar anti drop fire feature is disclosed in the U.S. Pat. No. 4,025,029 patent to Kotas et al.

Figure 2:
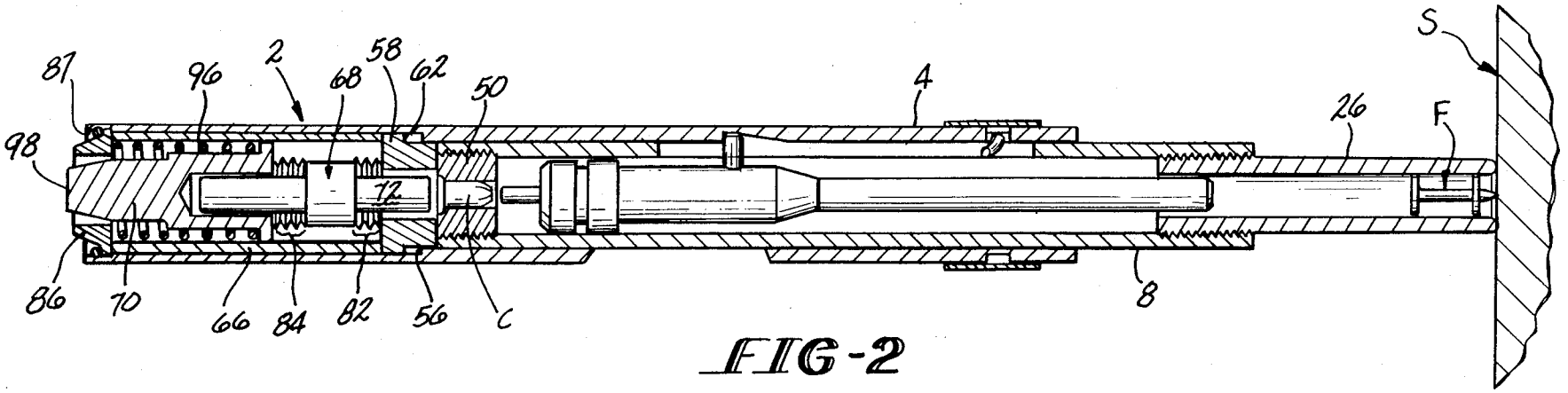
FIG. 2 is a sectional view similar to FIG. 1 but showing the tool cocked and ready to fire.

It will be noted that there is a gap between the sleeve 66 and the retainer 86 which allows the firing pin retainer 58 and the sleeve 66 to slide toward the retainer 86 to cock the tool when the muzzle bushing 26 is pressed against a work surface S into which the fastener F is to be driven. The cocked condition of the tool 2 is shown in FIG. 2. When the muzzle bushing 26 is pressed against the work surface S, the barrel 8 moves further into the housing 4 and thus moves against the firing pin retainer 58 to move the firing pin retainer shoulder 62 away from the housing shoulder 56. This slides the sleeve 66 against the firing mechanism retainer 86. Movement of the retainer 58 toward the retainer 86 causes the firing pin 68 and the driver 70 to move concurrently. The two Bellville washer sets 82 and 84 translate the movement of the retainer 58 to the firing pin 68 and the driver 70, respectively. In the cocked condition, the surface 98 of the driver 70 projects beyond the retainer 86 and the coil spring 96 is compressed. It will be appreciated that the pressure exerted on the Bellville washers in the sets 82 and 84 is not enough to flatten the washers. It will also be noted that the firing pin retainer 58 and the firing pin nose 72 are closely spaced to the head of the chambered cartridge C so as to provide support for the cartridge head and to help to prevent loss of power should the cartridge head fail by blowing out. As will be noted from FIG. 2, the driver 70 can be struck by a hammer in the protruding position. When the driver 70 is thus struck, it moves agianst the Bellville washer set 84 which, in turn, moves against the firing pin 68. The firing pin 68 thus moves against the Bellville washer set 82 which moves against the firing pin retainer 58, which is fixed against muzzleward movement due to its engagement with the barrel 8 and cartridge chamber 50. The hammer blow thus flattens the Bellville washers in the washer sets 82 and 84 sufficiently to allow the firing pin nose 72 to strike the head of the cartridge C and fire the latter. After firing, the washer sets 82 and 84 re-expand to return the firing pin 68 to the position shown in FIG. 2.

Figure 3:
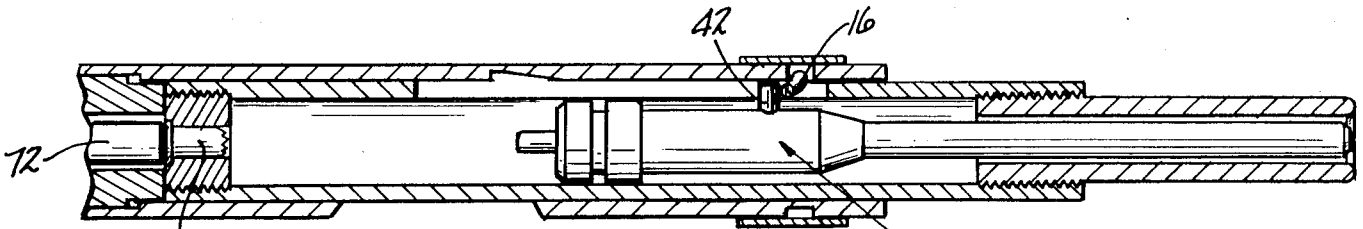
FIG. 3 is a fragmented sectional view of the tool of FIG. 1 after it has been fired.

When the tool is fired, the ram 30 is driven by combustion gases to its driven position shown in FIG. 3. In FIG. 3, the firing pin nose 72 is shown as it strikes the cartridge C. In the driven position, the return pawl 42 on the ram 30 is closely adjacent to the spring ring 16. Referring to FIGS. 6 and 7, the construction of the spring ring 16 is shown in detail. The ring 16 includes opposed springy legs 112 and 114, and an interconnecting bridge 116. A gap is provided in the ring 16 to allow it to be mounted on and removed from the housing groove 12. The medial portion 118 of the bridge 116 is angled out of the plane of the legs 112 and 114 toward the breechward end of the tool. This angled portion 118 of the ring 16 provides the part thereof which contacts the ram pawl 42 when the ram 30 is returned from its driven position to its driving position. It will be appreciated that the angled portion 118 of the ring 16 is resilient so that damage to the pawl 42 will not occur if the tool is throw-cocked.

Figure 4:
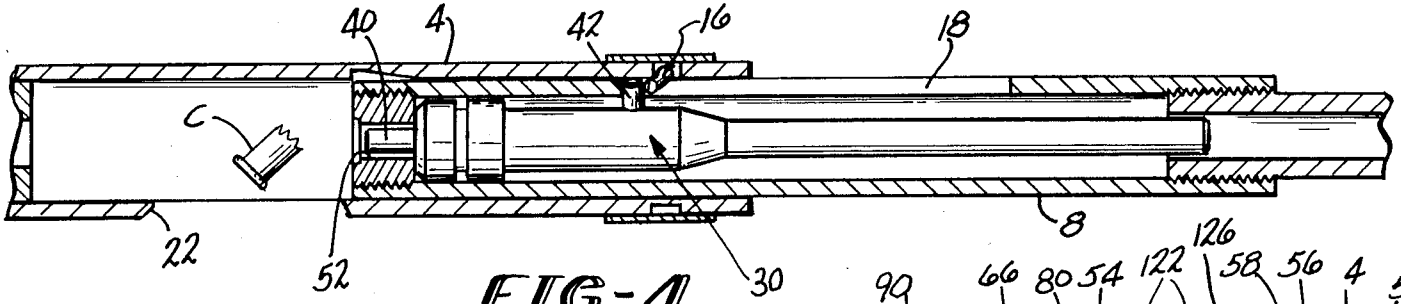
FIG. 4 is a fragmented sectional view similar to FIG. 3 showing how the barrel is manipulated to return the ram to its driving position and to eject the spent cartridge casing.

Referring to FIG. 4, the tool is shown as it is manipulated to return the ram 30 from its driven position to its driving position. The barrel 8 is moved muzzleward of the housing 4. The ring 16 thus forces the ram 30 breechward in the barrel 8, the pawl 42 sliding breechward through the slot 18. Muzzleward movement of the barrel 8 stops when the pawl 42 strikes the breechward end of the slot 18. At this point, the ejector 40 enters the cartridge chamber 52 sufficiently to push the expended cartridge C out of the firing chamber 52, whereupon, the cartridge C falls through the port 22. A fresh cartridge is then manually inserted into the cartridge chamber 52, pushing the ram 30 muzzleward slightly until the ejector tail 40 is out of the cartridge chamber 52, as shown in FIGS. 1 and 2. The barrel 8 is then returned to its breech-closed position, as shown in FIG. 1, whereupon the panel 42 re-engages the stop shoulder 7 formed by the notch 5, and the tool is ready to fire again once a fastener is placed in the muzzle bushing bore.

Figure 8:
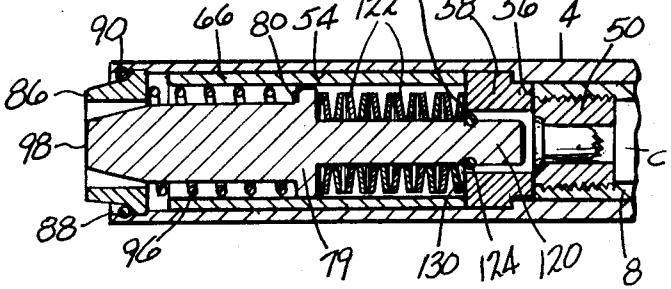
FIG. 8 is a sectional view of a second embodiment of the tool showing a modified firing mechanism used in the tool.

Referring now to FIG. 8, there is shown another embodiment of a firing mechanism adapted to be used with the tool of FIG. 1. The breechward end of the tool housing 4 is shown as well as the breechward end of the barrel 8 with the cartridge chamber 50. The housing 4 includes the counter-bore 54 in which the sleeve 66 is mounted. The firing pin retainer 58 which houses the firing pin 68 is disposed adjacent to the breechward end of the barrel 8 and the cartridge chamber 50. The firing pin driver and the firing pin are formed as a one-piece member 79 which is disposed in the sleeve 66 and includes the radial flange 80. The retainer ring 86 is mounted in the counter-bore 87 and is held in place by the spring ring 88 mounted in the groove 90. The spring 96 is compressed between the retainer 86 and driver flange 80 to bias the driver-firing pin member 79 toward the cartridge chamber 50. The member 79 has a muzzlewardly projecting finger 120 which is of reduced diameter. A set of Bellville washers 122 is mounted on the finger 120, the washers being held in place by a ring 124 seated in a groove 126 on the finger 120. Opposite ends of the Bellville washer set 122 engage the radial flange 80 on one hand, and the end surface 130 on the firing pin retainer 58 on the other hand. The washers 122 thus serve to hold the driver-firing pin member 79 in place against the bias of the spring 96.

It will be noted that the coil spring 96, via the flange 80 and Bellville washer set 122, biases the firing pin retainer 58 against the shoulder 56. The muzzleward end of the firing pin finger 120 extends into the bore of the firing pin retainer 58. The finger 120 has a small enough diameter so as to be freely movable in the bore of the firing pin retainer 58. When the tool is cocked by push down, as previously explained, the barrel 8 moves against the firing pin retainer 58 to move the latter away from the shoulder 56. The driver-firing pin member 79 is thus moved back so as to expose the driver end surface 98 to a hammer blow. When the hammer blow is delivered, the driver-firing pin member 79 moves muzzleward compressing the Bellville washers in the set 122, and the finger 120 is driven through the retainer 58 against the base of the cartridge C to fire the latter. After the hammer blow force is released, the Bellville washers in the set 122 reassume their original configuration, and the member 79 is moved away from the firing chamber 50. It will be seen that the firing mechanism provides full and controlled support for the cartridge head so as to minimize blowout, and so as to prevent loss of power should blowout of the cartridge head occur.

It will be readily appreciated that the tool of this invention will provide for improved resistance to drop fire due to the inaccessibility of the firing pin driver unless the tool is pushed down and cocked and due to the limited breechward movement available to the ram when in its driving position. Reduced wear and tear on the ram and ram return is provided as a result of the springy shock absorbing return surface. Proper positioning of the ram and barrel in the tool is maintained by the spring biased ram return pawl and the barrel notch stop. The tool can be easily disassembled for servicing or repair. Added protection against cartridge head blowout is also provided.

Since many changes and variations of the disclosed embodiments of the invention may be made without departing from the inventive concept, it is not intended to limit the invention otherwise than as required by the appended claims.

What is claimed is:

1. A cartridge-actuated fastener tool which is operated by a hammer blow, said tool comprising:

(a) a housing;

(b) a firing pin driver movably mounted in said housing, said driver having an end surface thereof positioned contiguous with an open breechward end of said housing;

(c) a firing pin movably mounted in said housing muzzleward of said driver;

(d) a firing pin retainer muzzleward of said firing pin and movably mounted in said housing, said firing pin retainer having a passage through which said firing pin can move;

(e) spring means engaging said driver and operable to bias said driver toward said firing pin retainer to maintain said end surface of said driver in a safe rest position with respect to said open breechward end of said housing wherein said end surface of said driver is inaccessible to a hammer blow;

(f) collapsible means engaging said firing pin retainer and said driver and operable to move said driver through a breechward cocking stroke against the bias of said spring means when said firing pin retainer is moved through a similar breechward cocking stroke; and (g) a barrel movably mounted in said housing, said barrel being movable to a breech-closed position wherein a breechward end of said barrel containing a cartridge chamber engages said firing pin retainer, said barrel being movable against said firing pin retainer and through a cocking stroke to concurrently move said firing pin retainer and said driver through said cocking strokes to place the tool in a firing condition, said end surface of said driver extending through said open breechward end of said housing when said tool is in said firing condition whereby said end surface of said driver is accessible to a hammer blow to fire the tool.

2. A firing mechanism for a cartridge-actuated fastener tool of the type having a housing and barrel being reciprocally slidably mounted in said housing, said firing mechanism comprising:

(a) a firing pin driver movably mounted in said housing, said driver having a first end portion thereof movable between a safe position substantially coextensive with an open end of said housing, and a firing position protruding from said open end of said housing for reception of a hammer blow;

(b) a firing pin movably mounted in said housing muzzleward of said driver;

(c) a firing pin retainer movably mounted in said housing and disposed about said firing pin to guide movement of said firing pin;

(d) spring means engaging said driver to bias the latter toward said firing pin retainer and into said safe position;

(e) collapsible connecting means engaging said firing pin retainer and said driver and operable to move said driver against the bias of said spring means and to said firing position in response to breechward cocking movement of said firing pin retainer within said housing; and (f) said barrel having a breechward cartridge chamber end part movable against said firing pin retainer to cock said firing pin retainer when said barrel is moved in a breechward direction within said housing.

3. In a cartridge-actuated fastener tool of the type having a reciprocating barrel and operated by a hammer blow, a firing mechanism having improved drop fire resistance and comprising:

(a) a firing pin breechward of said barrel;

(b) a separate firing pin driver breechward of said firing pin, said driver having a breechward end thereof adapted to be struck by a hammer to operate the tool;

(c) a firing pin retainer interposed between said barrel and said firing pin to guide movement of said firing pin;

(d) spring means biasing said driver toward said barrel to a first position wherein said breechward end of said driver is retracted within said tool to prevent striking thereof;

(e) collapsible means interconnecting said firing pin retainer and said driver; and (f) movement of said barrel in a breechward direction during a push down cocking stroke being operable to move said firing pin retainer, said collapsible means means, and said driver breechward to compress said spring means and move said breechward end of said driver to a projecting position out of the tool to expose said driver to a hammer blow to fire the tool.

4. The tool of claim 3, wherein said collapsible means comprises a stack of expanded Bellville washers engaging said firing pin retainer and said driver, and operable to be momentarily flattened when said driver is struck by a hammer whereby said driver can drive said firing pin through a muzzleward firing stroke.

5. The tool of claim 4 wherein said firing pin comprises a muzzleward nose portion, a medial flange, and a breechward tail portion, and said Bellville washers comprise a first stack thereof mounted on said nose portion and sandwiched between said firing pin retainer and said medial flange, and said Bellville washers also comprise a second stack thereof mounted on said tail portion and engaging said medial flange and said driver.

6. The tool of claim 3 wherein said driver and said spring means are disposed in a sleeve breechward of said firing pin retainer, said sleeve being slidably mounted in said tool.

7. The tool of claim 3 further comprising a firing mechanism retainer ring mounted in a breechwardmost end of said tool, said retainer ring engaging one end of said spring means and having a through bore through which said driver projects.

8. A cartridge-actuated fastener tool comprising:

(a) a housing;

(b) a barrel reciprocally slidably movable in said housing, said barrel having a bore;

(c) a ram mounted in said barrel bore for movement therein between a driving position and a driven position;

(d) a slot in said barrel extending longitudinally thereof, said slot opening into said barrel bore;

(e) a pawl mounted in said ram and extending radially thereof, said pawl being spring biased in a radially outward direction into frictional engagement with an inside surface of said housing whereby said pawl is operable to frictionally retain said ram in said driving position, and said pawl is further operable to frictionally retain said barrel in a breech-closed position in said housing.

9. The tool of claim 8 comprising means forming a stop on said inside surface of said housing, said stop being engaged by said ram pawl when said ram is in said driving position, and said stop being operable to prevent said ram from moving breechward in said barrel from said driving position.

10. The tool of claim 9 wherein said means forming a stop comprises a notch formed in said inside surface of said housing along the path of movement of said ram pawl.

11. The tool of claim 8 further comprising a ram return ring mounted on said housing, said ram return ring including a springy portion extending into said barrel slot at a muzzleward end thereof for engagement with said pawl when said ram is in said driven position, said springy portion providing a yielding shock absorbing ram return means on said housing.

12. The tool of claim 11 further comprising a removable sleeve mounted on said housing outwardly overlying said ram return ring.

13. A cartridge-actuated fastener tool comprising:

(a) a housing;

(b) a barrel having a bore, said barrel being reciprocally slidably mounted in said housing for movement between a breech-open position and a breech-closed position;

(c) a cartridge chamber positioned in a breechward end of said barrel;

(d) a ram disposed in said barrel bore and movable therein between a driving position and a driven position, said ram having a cartridge extractor portion mounted on a tail end of said ram for entering said cartridge chamber to extract a chambered cartridge breechwardly when said ram is in said driving position, and said barrel is in said breech-open position;

(e) stop means on said tool for engaging said ram to prevent said extractor portion from entering said cartridge chamber when said ram is in said driving position and said barrel is in said breech-closed position; and (f) means on said tool for moving said ram from said driven position to said driving position in response to movement of said barrel from said breech-closed position to said breech-open position.

14. The tool of claim 13 wherein said stop means comprises a notch in an internal surface of said housing forming a stop shoulder operable to engage a return pawl on said ram when said ram is in said driving position.

15. A cartridge-actuated fastener tool which is operated by a hammer blow, said tool comprising:

(a) a housing;

(b) a one-piece firing member having a breechward driver part, a muzzleward firing pin part, and a radially enlarged medial flange between said driver and firing pin parts, said firing member being mounted in said housing with a breechward end of said driver part being positioned contiguous with an open breechward end of said housing;

(c) a firing pin retainer muzzleward of said firing pin part and movably mounted in said housing, said firing pin retainer having a passage through which said firing pin part can move;

(d) spring means mounted on said driver part of said firing member and engaging said firing member medial flange to bias said firing member in a muzzleward direction whereby said breechward end of said driver part is maintained in a safe rest position with respect to said open breechward end of said housing wherein said breechward end of said driver part is inaccessible to a hammer blow;

(e) collapsible means mounted about said firing pin part and engaging said firing member medial flange and said firing pin retainer, said collapsible means being operable to move said firing member through a breechward cocking stroke to a cocked position against the bias of said spring means when said firing pin retainer is moved through a similar breechward cocking stroke; and (f) a barrel movably mounted in said housing, said barrel being movable to a breech-closed position wherein a breechward end of said barrel containing a cartridge chamber engages said firing pin retainer, said barrel being movable against said firing pin retainer and through a cocking stroke to concurrently move said firing pin retainer and said firing member through said cocking strokes to place the tool in a firing condition, said breechward end of said driving part extending through said open breechward end of said housing when said tool is in said firing condition whereby said breechward end of said driving part is accessible to a hammer blow to fire the tool.

16. The tool of claim 15 wherein said collapsible means is a stack of Bellville washers which momentarily collapses axially when said firing member is struck with a hammer when in said cocked position.

17. The tool of claim 16 wherein said Bellville washer stack is held on said firing pin part by a snap ring fitted onto said firing pin part muzzleward of said washer stack.

* * * * *